US005876249A

United States Patent [19]

Kim

[11] Patent Number: 5,876,249

[45] Date of Patent: Mar. 2, 1999

[54] WEDGE-BASE LAMP SOCKET

[75] Inventor: YongSoo Kim, Ansan, Rep. of Korea

[73] Assignee: Molex Incorporated, Lisle, Ill.

[21] Appl. No.: 785,119

[22] Filed: Jan. 21, 1997

[30] Foreign Application Priority Data

Feb. 2, 1996 [KR] Rep. of Korea ..... 96-1611
Oct. 18, 1996 [KR] Rep. of Korea ..... 96-34368

[51] Int. Cl.[6] ..... H01R 17/00

[52] U.S. Cl. ..... 439/619; 439/856; 439/751

[58] Field of Search ..... 439/619, 699.2, 439/611, 751, 873, 856, 890, 752, 752.5, 857

[56] References Cited

U.S. PATENT DOCUMENTS

| | | | |
|---|---|---|---|
| 3,027,537 | 3/1962 | Hess et al. | 439/699.2 |
| 4,350,404 | 9/1982 | Clark et al. | 439/398 |
| 4,610,497 | 9/1986 | Tsuchida et al. | 339/176 L |
| 4,618,205 | 10/1986 | Freeman | 339/125 L |
| 4,725,241 | 2/1988 | Matsuoka et al. | 439/619 |
| 4,902,251 | 2/1990 | Grzena | 439/699.2 |
| 4,906,209 | 3/1990 | Tanabe et al. | 439/751 |
| 4,957,455 | 9/1990 | Horiuchi et al. | 439/548 |
| 5,000,702 | 3/1991 | Forish et al. | 439/699.2 |
| 5,008,588 | 4/1991 | Nakahara | 439/699.2 |
| 5,046,972 | 9/1991 | Pass | 439/751 |
| 5,277,605 | 1/1994 | Roscizewski et al. | 439/921 |
| 5,286,223 | 2/1994 | Ogawa | 439/619 |
| 5,637,020 | 6/1997 | Ito | 439/699.2 |

FOREIGN PATENT DOCUMENTS

| | | |
|---|---|---|
| 02181-376-A | 7/1990 | Japan . |
| 9200614 | 4/1989 | Rep. of Korea . |
| 9200615 | 4/1989 | Rep. of Korea . |
| 220111 | 4/1989 | United Kingdom . |

*Primary Examiner*—Paula Bradley
*Assistant Examiner*—Tho D. Ta
*Attorney, Agent, or Firm*—James C. Paschall

[57] ABSTRACT

A wedge-base lamp socket comprises a socket body having a lamp holder for holding a wedge-base lamp. The lamp holder includes an outside wall, a pair of opposite receiving portions disposed inside the outside wall and opposed inside walls diametrically extending between the receiving portions. The inside walls define an elongated channel therebetween for receiving a wedge base of a lamp. The opposed inside walls include a pair of opposed recesses adjacent to each of the receiving portions each including a guide groove therein. A pair of terminals are oppositely mounted in the lamp holder. Each terminal has a bracket part received in a respective one of the receiving portions and a pair of clamp arms connected to the bracket part. The clamp arms extend upwardly along both sides of the bracket part and are adapted for clamping the wedge base of the lamp. Each clamp arm is received within a respective recess in the pair of opposed recesses and includes a protrusion on an outer surface of the clamp arm for reception in the guide groove.

15 Claims, 7 Drawing Sheets

WEDGE-BASE LAMP SOCKET

FIELD OF THE INVENTION

The present invention relates in general to a wedge-base lamp socket generally used for automobiles and, more particularly, to a structural improvement in such sockets for easing assembly of a wedge-base lamp with the socket and for allowing wire leads of the wedge-base lamp to more reliably make electrical contact with the terminals of the socket.

DESCRIPTION OF THE PRIOR ART

As is well known to those skilled in the art, wedge-base lamps that have wire leads folded back on opposite sides of a flat glass base have been preferably used to illuminate automobile lights. Typical lamp sockets for such wedge-base lamps have a construction corresponding to the construction of the wedge-base lamp.

FIG. 1 shows a typical wedge-base lamp 10 and a terminal 20. A glass wedge base 12 of the lamp 10 has a first side 12*a* and a second side 12*b*. Each side 12*a*, 12*b* is bifurcated into a left half 12*l* and a right half 12*r* by an integral glass peg 12*c*. Wire leads 14 are folded back only on the left half 12*l* of the first and second opposite sides 12*a*, 12*b* of the glass wedge base 12 of the lamp 10, so the wire leads 14 are exposed outside the base 12. Each half 12*l*, 12*r* of each side 12*a*, 12*b* of the glass base 12 is transversely pressed to form an indented portion 16. The wire lead 14 on the left half 12*l* of the base often has a curved segment 18 which nests within the indented portion 16.

The terminal 20 generally comprises a bracket part 22, opposite, first and second clamp arms 24*a* and 24*b* and a connector contact 28. The bracket part 22 is a plate portion having a generally rectangular configuration. The first and second clamp arms 24*a*, 24*b* are provided on both sides of the bracket part 22, respectively. The connector contact 28 is a strip portion that extends downwardly from the lower end of the bracket part 22. A pair of fitting flanges 30 are provided on both sides in the upper portion of the bracket part 22. The bracket part 22 also includes a stop tongue 32. The tongue 32 is formed by making a U-shaped cut in the center portion of the bracket part 22 and gently bending the tongue 32 outwardly.

Each clamp arm 24*a*, 24*b* is connected to the bracket part by an angular portion which is perpendicularly bent with respect to the bracket part 22. The clamp arms 24*a*, 24*b* extend upwardly along the side of the bracket part 22 to a free upper portion. The upper portion of each clamp arm 24*a*, 24*b* is smoothly bent inwardly and in turn bent outwardly to form smoothly bent clamping bends 26*a*, 26*b*, respectively. FIG. 2 shows a top plan view of the typical wedge-base lamp socket 40. The socket body 42 has a generally cylindrical configuration and is formed of an insulating synthetic resin. The lamp holder 46 is defined by an outside, cylindrical wall 54 of the socket body 42. A pair of opposed, receiving portions 56 are integral with the outside, cylindrical wall 54. Each receiving portion 56 includes a back side 60 against the outside wall 54 flanked by a pair of L-shaped walls 58. A first portion 58*a* of each L-shaped wall 58 extends from the back side 60, and a second portion 58*b* of each L-shaped wall 58 opposes the back side 60. Consequently, the back wall and the pair of L-shaped walls 58 together define an opening 62 in the guide portion flanked by two opposed flange guide grooves 64. A channel 65 extends vertically down the middle of each back side 60.

Two inside walls 66 diametrically extend between the two receiving portions 56 to define an elongated channel 68 with a cylindrical cutout 70 at the center of the inside walls 66. Two recesses 72 are disposed in each inside wall 66 on both sides of the cylindrical cutout 70 between the cutout 70 and the receiving portions 56. Each recess 72 is aligned with an opposed recess 72 in the opposing inside wall 66 across the channel 68 to provide two pairs of aligned recesses 72. The flange guide grooves 64 in the receiving portions 56 with the elongated channel 68 define an aggregate recess 72 having a generally I-shaped cross-section suitable to receive the glass wedge base 12 of the lamp 10. The glass peg 12*c* in the wedge base fits into the cylindrical cutout 70.

As shown in FIG. 3, the lamp holder 46 is at one end of the socket body 42 for receiving and holding the glass base 12 of the wedge-base lamp 10 (shown in phantom). A connector holder 48 is at the other end of the body 42 for receiving and holding an electrical connector 50 (shown in phantom). The connector 50 supplies electric power for the lamp 10. The lamp holder 46 and the connector holder 48 are separated by an insulative partition 52. An annular flange 44 is formed on the outer surface of the cylindrical socket body 42 for mounting purposes. An internal ring is 74 formed on the inner side of the outside wall 54 of the body 42.

Two terminals 20 are mounted each at opposite ends of the elongated channel 68 in the lamp holder 46. One terminal 20 is used as a positive terminal, while the other terminal 20 is used as a grounding terminal. The bracket part 22 of each terminal 20 is fitted into the respective receiving portion 56 at the outside wall 54 of the body 42 to mount the terminal 20 in its place inside the lamp holder 46. The fitting flanges 28 fit in the flange guide grooves 64 of the receiving portion 56 for setting the forward and backward position of each terminal 20 inside the lamp holder 46. Each of the flange guide grooves 64 of the receiving portion 56 guides the respective fitting flange 28 of the terminal 20 during insertion. The tongue 32 of the terminal 20 slides down the channel 65 and is stopped by the internal ring 74, so each terminal 20 is prevented from being easily removed from the holder 46. The opposed clamp arms 24 of each terminal 20 fit within the corresponding pair of opposed, aligned recesses 72 in the inside walls 66 along the elongated channel 68 upon insertion of the terminal 20 into the holder 46.

As shown in FIG. 3, when the wedge-base lamp 10 is inserted into the lamp holder 46, the clamp arms 24*a*, 24*b* are elastic enough to laterally flex. The recesses 72 in the inside walls 66 provide sufficient depth to allow the free upper portions of the clamp arms 24*a*, 24*b* to flex outwardly to receive the wedge base. Subsequently, the free upper portions flex inwardly to elastically clamp the wedge base 12 of the wedge-base lamp 10.

FIG. 4*a* shows how the lamp 10 sits in the terminal 20. The first clamping bend 26*a* of the first clamp arm 24*a* on the terminal 20 flexes inwardly to make electrical contact with the wire lead 14 on the left half 12*l* on the first side 12*a* of the wedge base 12. The first clamping arm 24*a* contacts the lead 14 at a lead contact point 92. For wire leads which include a curved segment 18, for example as shown in FIG. 4*a*, the lead contact point 92 is near the curved segment 18 of the wire lead 14. The smoothly bent second clamping bend 26*b* of the second clamp arm 24*b* on the second side 12*b* of the terminal 20 elastically flexes inwardly and snaps into the indented portion 16 on the right half 12*r* of the second side 12*b* of the glass wedge base 12, thereby tightly holding the lamp 10 in the holder 46. The second clamping bend engages the indented portion 16 at an indent engagement point 94. Additionally, the second clamping bend 26*b* of the second clamp arm 24*b* only clamps the right half 12*r* of the glass base 12 and does not make electrical contact with the lead 14.

As shown in FIG. 3, the connector contacts 28 of the terminals 20 in the lamp holder 46 project into the connector holder 48 of the body 42 through guide holes 76 in the partition 52. The contacts are then brought into electrical contact with the terminals of the connector 50, shown in phantom in FIG. 3, held in the connector holder 48. Rubber packings 78, 80 and 82 seal the wedge-base lamp socket 40 in its environment.

In order to stably install the opposite terminals 20 in the lamp holder 46 of the body 42, the connector contact 28 of each terminal 20 must be precisely inserted along an axis of insertion 90 into the associated guide hole 76 in the partition 52 of the body 42. The guide hole 76 primarily positions the terminal 20 in the holder 46 during the terminal installation process. The terminal installation process is continued by carefully pushing the terminal 20 into the holder 46 while inserting the fitting flanges 28 of the bracket part 22 into the flange guide grooves 64 of the receiving portions 56 and the clamp arms 24 into the recesses 72 in the inside walls 66 of the socket body 42, respectively. By fitting the flanges 28 into the grooves 64, each terminal 20 is secondarily positioned in the holder 46. Each terminal 20 is further pushed into the holder 46 until the stop tongue 32 hooks the ring 74 of the socket body 42. The terminals 20 are, thus, completely assembled within the socket body 42 in the wedge-base lamp socket.

The wedge-base lamp socket 40 has the following problems. Each terminal 20 laterally moves in the holder 46 during insertion of the terminal 20 into the holder 46 because each terminal 20 is positioned and held exclusively by the connector contact 28 engaged in the guide hole 76. Because the clamp arms 24 are loosely received in the opposed, aligned recesses 72, the terminal 20 is not stably held in the lamp holder 46 until the flanges 28 are inserted in the flange guide grooves 64. Such movement of each terminal 20 in the holder 46 during the terminal installing process not only prolongs the socket assembly time, but it also reduces the quality of the socket 40.

Another problem with the lamp socket 40 is that the first clamping bends 26*a* of the first clamp arms 24*a* may fail to establish electrical contact with the wire leads 14 of the lamp 10. In order to establish contact between the wire leads 14 and the clamping bends 26 with less likelihood of failure, the lamp 10 must be precisely fitted in the lamp holder 46 to assure that the first clamping bends 26 correctly clamp the wire leads 14 and the second clamping bends 26 correctly clamp the indented portion 16. However, the wire leads 14 of typical wedge-base lamps are often bent to conform to the configuration of the indented portions 16 which are pressed to have various configurations. Thus, the wire leads frequently have different bent configurations. The smooth clamping bends 26*a* having a fixed configuration may fail to establish electrical contact with the wire lead 14 having one of several different configurations.

Furthermore, the first clamping bend 26*a* of the terminal often contacts the wire lead at the first side 12*a* of the base at a lead contact point 92 which is not symmetrically aligned with an indent engagement point 94 at which the second clamping bend engages the indented portion on the second side 12*b* of the base 12. Because the lead 14 is only folded over the first side 12*a* of the left half 12*l* of the base 12, the base 12 has an asymmetrical profile. As shown in FIG. 4*a*, the force directed against the terminal from the lead contact point 92 generates a moment about the indent engagement point 94. Because the lamp is anchored in the elongated channel 68 (not shown in FIG. 4*a*), the moment biases the terminal to rotate out of alignment with the axis of insertion 90, thereby subjecting the lamp, the terminal 20 and the socket 40 to additional stress. In the case of the leads 14 with a curved segment 18 nested within the indented portion 16 of the base 12 as shown in FIG. 4*a*, the lead contact point 92 is usually below the curved segment 18 at a relative vertical position which is below the vertical position of the indent engagement point 94.

Lastly, the automobiles utilizing the wedge-base lamp sockets 40 tend to subject the socket 40 to repeated joggling while moving, thereby complicating the maintenance of electrical contact between the wire leads 14 and the terminals 20.

SUMMARY OF THE INVENTION

It is, therefore, an object of the present invention to provide a wedge-base lamp socket for automobiles which overcomes the above problems. It is an additional object of the present invention to provide a wedge-base lamp socket with terminals that are easily assembled into the socket body. It is a further object of the present invention to provide a wedge-base lamp socket with terminals which come into electrical contact with the wire leads of a typical wedge-base lamp without failure, thereby improving the operational reliability of the wedge-base lamp socket.

In order to accomplish the above objects, a wedge-base lamp socket for automobiles in accordance with a preferred embodiment of the present invention comprises a socket body having a lamp holder for holding a wedge-base lamp. The lamp holder includes an outside wall, a pair of opposite receiving portions disposed inside the outside wall and opposed inside walls diametrically extending between the receiving portions. The inside walls define an elongated channel therebetween for receiving a wedge base of a lamp. The opposed inside walls include a pair of opposed recesses adjacent to each of the receiving portions each including a flange guide groove therein. A pair of terminals are oppositely mounted in the lamp holder. Each terminal has a bracket part received in a respective one of the receiving portions and a pair of clamp arms connected to the bracket part. The clamp arms extend upwardly along both sides of the bracket part and are adapted for clamping the wedge base of the lamp. Each clamp arm is received within a respective recess in the pair of opposed recesses and includes a protrusion on an outer surface of the clamp arm for reception in the flange guide groove.

Preferably, to ensure improved engagement by the clamp arms, each clamp arm has a clamping bend provided with a knurled inner clamping surface. Additionally, a first clamping bend of the first clamp arm is preferably provided with a greater radius of curvature than a second clamping bend on the second clamp arm. By providing the first clamping bend with a greater radius of curvature, the first clamping bend contacts the wire lead at two contact points, thereby offsetting a moment asymmetrically directed forces bearing against the wedge base.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 5:
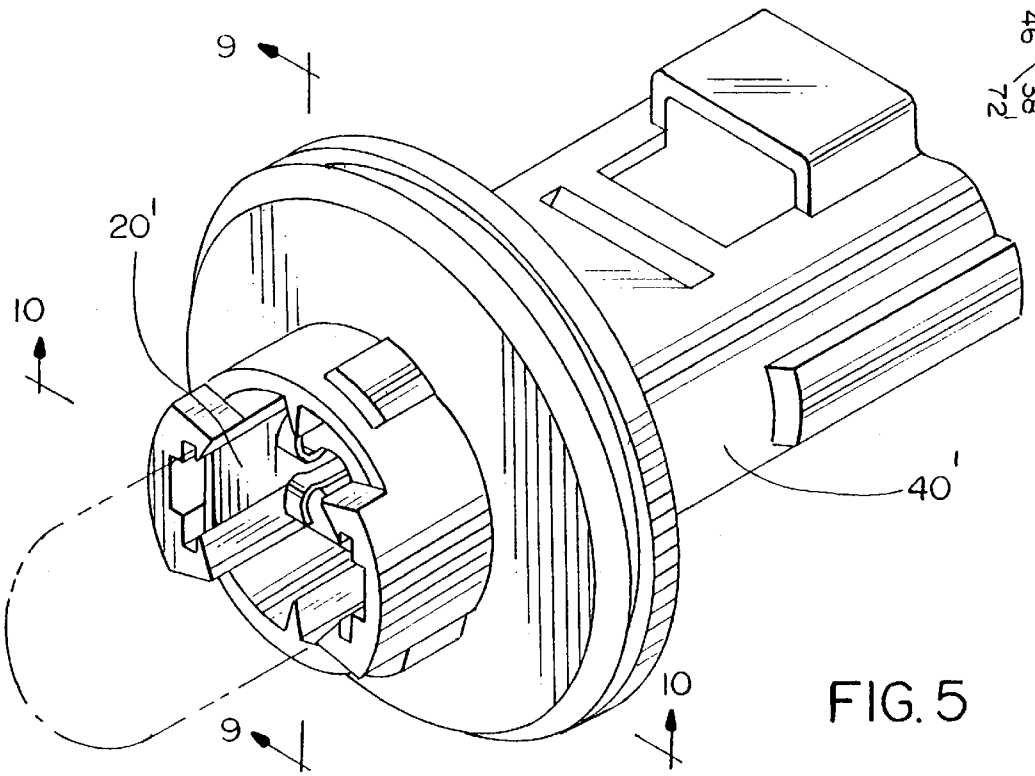
FIG. 5 is a perspective view of the wedge-base lamp socket of the preferred embodiment of the present invention.
Figure 6A:
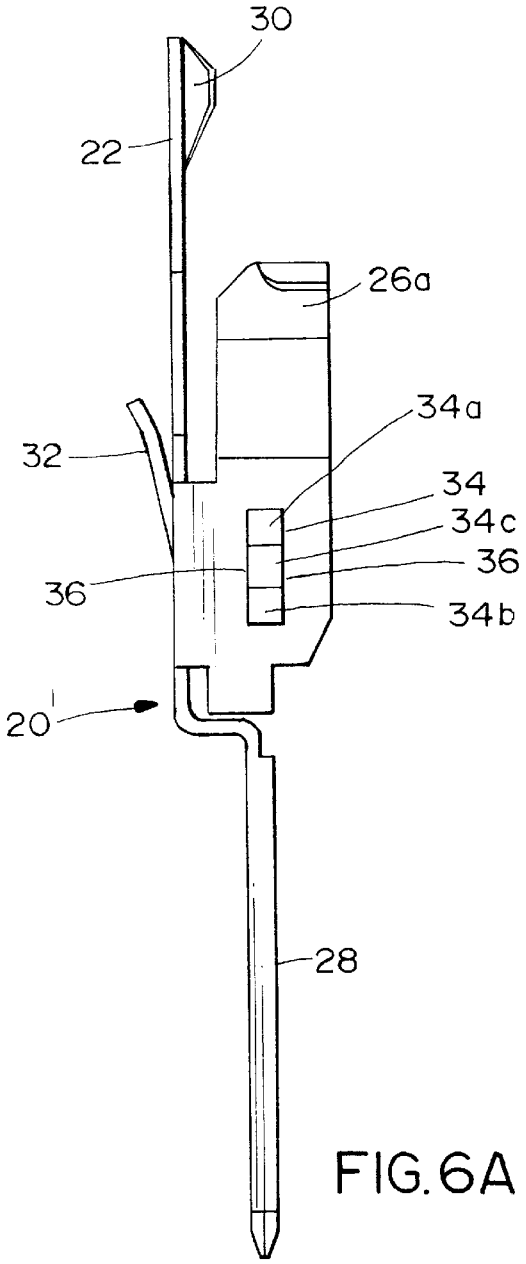
FIGS. 6*a* and 6*b* are front and side views showing the construction of the terminal in FIG. 4*b*, respectively.
Figure 6B:
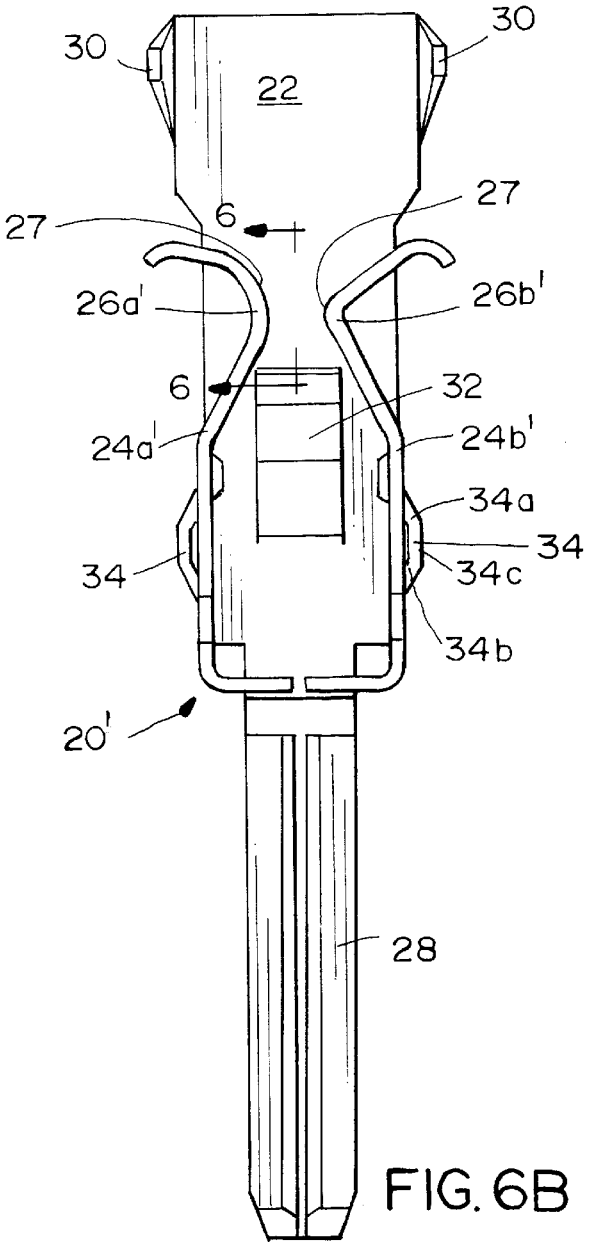

FIG. 5 shows the wedge-base lamp socket 40' of the present invention. FIGS. 6*a* and 6*b* are front and side views of a terminal 20' used in a wedge-base lamp socket 40' in accordance with a preferred embodiment of the present invention, respectively. In the wedge-base lamp socket 40' and the terminal 20', most of the parts are common with those previously described. Those parts common to both the typical terminal socket 40 and the terminal 20 and the terminal 20' and the socket 40' of this invention will thus carry the same reference numerals.

The terminal 20' of this invention comprises a bracket part 22, a pair of opposite, first and second clamp arms 24*a*', 24*b*' and a connector contact 28. The bracket part 22 is a plate portion having a generally rectangular configuration. First and second clamp arms 24*a*' and 24*b*' are provided on both sides of the bracket part 22 to elastically clamp the flat glass base 12 and contact the wire leads 14 of a wedge-base lamp 10. The connector contact 28 is a strip portion that extends downwardly from the lower end of the bracket part 22. A pair of fitting flanges 30 are provided on both sides in the upper portion of the bracket part 22. The bracket part 22 also includes a stop tongue 32. The tongue 32 is formed by making a U-shaped cut in the center portion of the bracket part 22 and gently bending the tongue 32 backward. Each clamp arm 24*a*' and 24*b*' is joined to the bracket part 22 by an angled portion bent at a right angle and extends upwardly along the side of the bracket part 22.

In accordance with the preferred embodiment of the present invention, a protrusion 34 is formed on the outer surface of each clamp arm 24*a*' and 24*b*'. The protrusion 34 is preferably a band defined by two parallel slots 36 stamped in the clamp arms 24' adjacent the angled portion of the clamp arm 24'. The band is trapezoidally formed to have two legs 34*a*, 34*b* extending from the clamp arm 24' and a bridge 34*c* connecting the two legs 34*a*, 34*b*. The protrusion 34 protrudes in a direction generally perpendicular to the direction in which the fitting flanges 30 extend.

Figure 7:
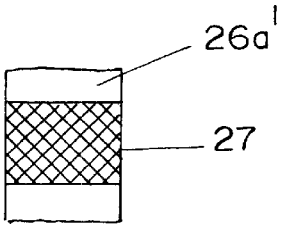
FIG. 7 is an elevational view taken along the segment 7—7 in FIG. 6*b*.

A free upper portion of each clamp arm 24*a*' and 24*b*' is smoothly bent inwardly and in turn bent outwardly to form smoothly bent first and second clamping bends 26*a*' and 26*b*', respectively. In accordance with the preferred embodiment of the present invention, each clamping bend 26*a*', 26*b*' is knurled to form a knurled clamping surface 27 as shown in FIG. 7. Additionally, the first clamping bend 26*a*' is bent to have a greater radius of curvature than the second clamping bend 26*b*'. The preferred radius of curvature of the first and second clamping bends 26*a*', 26*b*' will depend on the profile of the wedge base 12 and lead 14. It is believed that the preferred radius of curvature for the first clamping bend 26*a*' is 1.5 mils, and the preferred radius of curvature of the second clamping bend 26*b*' is 0.6 mils. Moreover, the first clamp arm 24*a*' is preferably on the left side of the terminal and the second clamp arm 24*b*' is preferably on the right side of the terminal as viewed in FIG. 6*b*.

Figure 8:
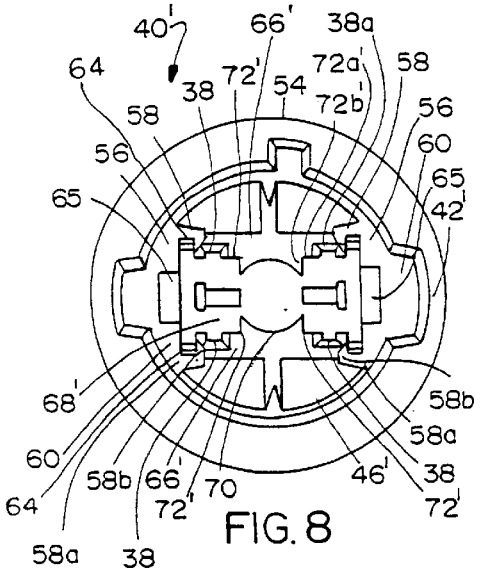
FIG. 8 is a top plan view of the socket of FIG. 5.

As shown in FIG. 8 of the wedge-base lamp socket 40' of the present invention, the lamp holder 46' is defined by an outside, cylindrical wall 54 of the socket body 42'. A pair of opposed, receiving portions 56 are integral with the outside cylindrical wall 54. Each receiving portion 56 includes a back side 60 against the outside wall 54 flanked by a pair of L-shaped walls 58. A first portion 58*a* of each L-shaped wall 58 extends from the back side 60, and a second portion 58*b* of each L-shaped wall 58 opposes the back side 60. Consequently, the back wall and the pair of L-shaped walls 58 together define an opening 62 in the receiving portion 56 flanked by two opposing flange grooves 64. A channel 65 extends vertically down the middle of each back side 60.

Two inside walls 66' diametrically extend between the two receiving portions 56 to define an elongated channel 68' with a cylindrical cutout 70 at the center of the inside walls 66' for receiving the wedge base of the lamp. The cutout 70 receives the peg 12*c* in the wedge base of the lamp. Two recesses 72' are disposed in each inside wall 66' on both sides of the cylindrical cutout 70 between the cutout 70 and the receiving portions 56, thereby providing two pairs of opposed, aligned recesses 72' in the opposing, inside walls 66'. Each recess 72' comprises a first longitudinal wall 72*a*' facing the channel 68' and a second longitudinal wall 72*b*' joining the inside wall 66'.

In accordance with the preferred embodiment of the present invention, as shown in FIG. 8, the socket body 42' also includes protrusion guide grooves 38 for guiding the movement of the protrusions 34 of each terminal 20' when mounting the terminal 20' in the lamp holder 46'. The protrusion guide grooves 38 are preferably formed in the first longitudinal wall 72*a*' of each of the aligned recesses 72' in the opposed, inside walls 66'. Top perimeter edges 38*a* of the protrusion guide grooves 38 are preferably chamfered to facilitate insertion of the protrusions 34.

Figure 9:
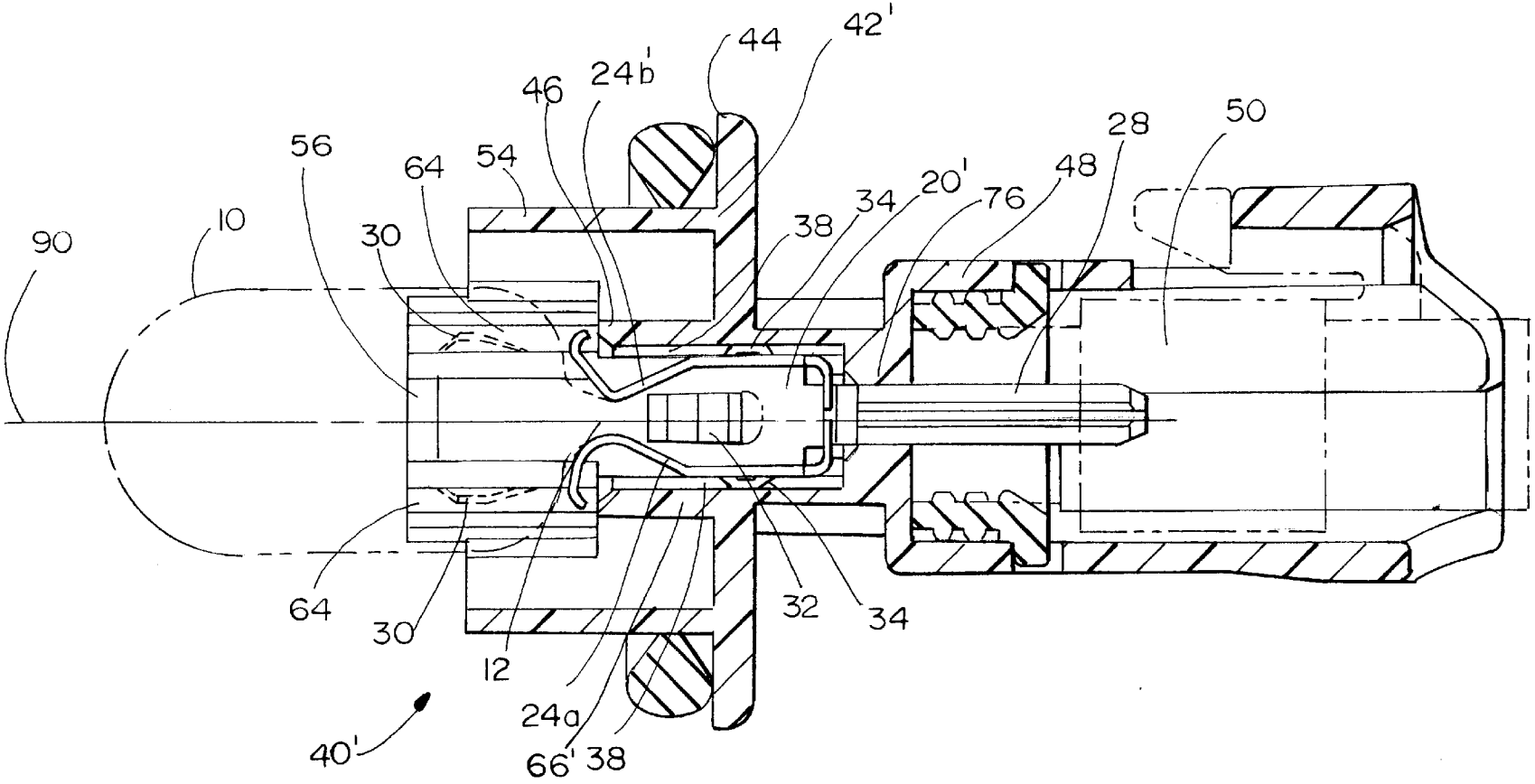
FIG. 9 is a sectional view of the socket in FIG. 5 taken along segment 9—9.
Figure 10:
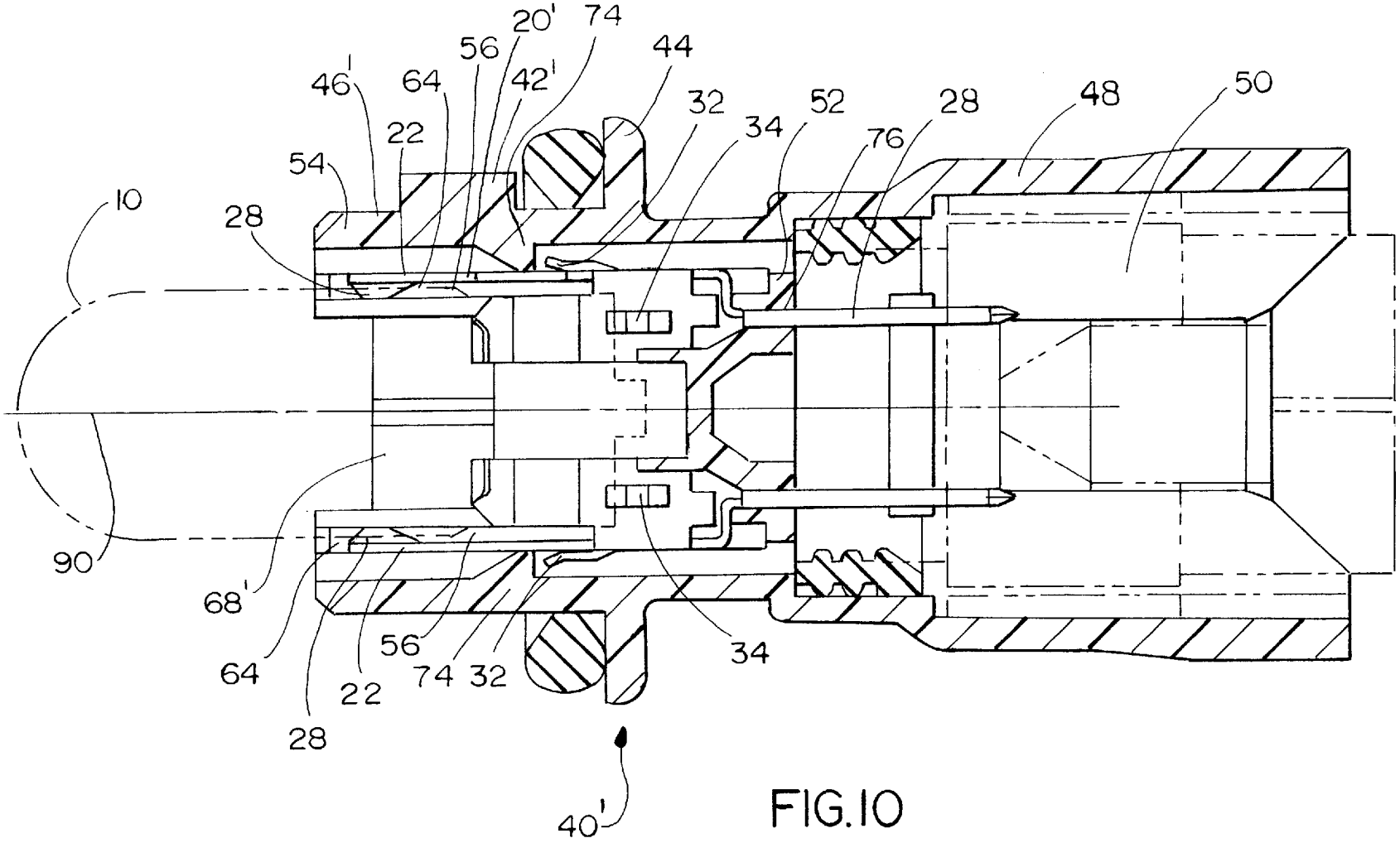
FIG. 10 is a sectional view of the socket in FIG. 5 taken along segment 10—10.

As shown in FIGS. 9 and 10, the socket body 42' is formed into a generally cylindrical configuration from an insulating synthetic resin. An annular flange 44 is formed on the outer surface of the cylindrical socket body 42' for mounting purposes. An internal ring 74 is formed on the inner side of the outside wall 54 of the body 42'. One end portion of the socket body 42' is a lamp holder 46' for holding the wedge base 12 of the wedge-base lamp 10, while the other end portion of the body 42' is a connector holder 48 for holding an electrical connector 50. The lamp holder 46' is separated from the connector holder 48 by a partition 52.

As shown in FIG. 10, two identical terminals 20' are each mounted facing each other at opposite ends of the elongated channel 68' in the lamp holder 46'. One terminal 20' is used as a positive terminal, while the other terminal 20' is used as a grounding terminal. The bracket part 22 of each terminal 20' is fitted into the respective receiving portion 56 at the outside wall 54 of the body 42' to mount the terminal 20' in place inside the lamp holder 46'. The fitting flanges 28 on the upper portion of the bracket part 22 fit in the first flange guide grooves 64 of the receiving portion 56 for setting the forward and backward position of each terminal 20' inside the lamp holder 46'. The flange guide grooves 64 of the receiving portion 56 guide the insertion of each fitting flange 28 of the terminal 20'.

The terminal 20' is assembled into the lamp holder 46' of the socket body 42' of the wedge-base lamp socket 40' as follows with reference to FIGS. 9 and 10. The connector contact 28 of each terminal 20' is inserted into an associated guide hole 76 in the partition 52 along an axis of insertion 90 primarily to hold the terminal 20' inside the holder 46'. When each terminal 20' is further pushed into the holder 46', the protrusions 34 of the terminals 20' are inserted into and guided by the protrusion guide grooves 38 of the body 42'. The terminal 20' is, thus, secondarily held in the holder 46' during insertion. The terminal 20' is even more stably held in the holder 46' once the fitting flanges 28 are inserted into and guided by the flange guide grooves 64 of the body 42'. The protrusions 34 are guided by the protrusion guide grooves 38 before the flanges 28 are inserted into the flange guide grooves 64, so each terminal 20' can be continuously stably held during the process of installing the terminals 20' into the socket body 42'. When the terminal 20' is fully inserted into the socket body 42', the stop tongue 32 moves beyond and is caught by the internal ring 74, so each terminal 20' is prevented from being easily removed from the holder 46'. The terminals 20' are, thus, easily and stably assembled within the socket body 42' of the lamp socket 40'. The wedge-base lamp socket 40' of this invention reduces assembly time and has improved quality.

Figure 1:
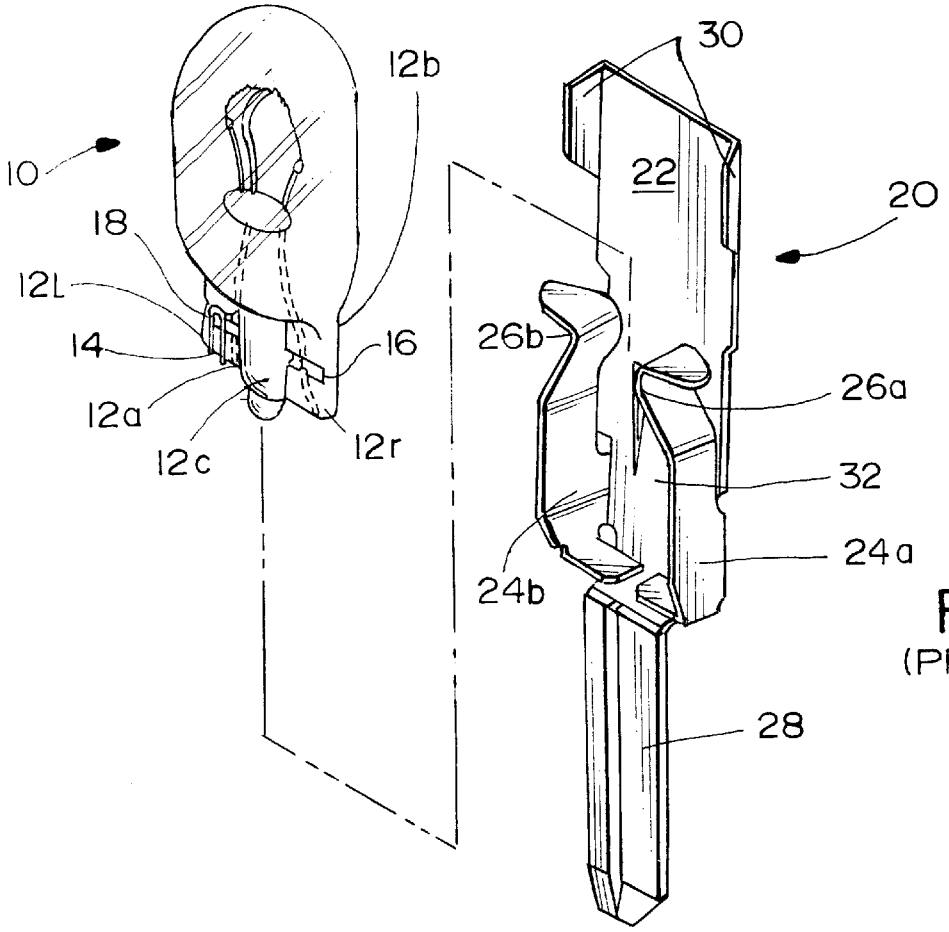
FIG. 1 (PRIOR ART)
FIG. 1 is an exploded perspective view showing both a wedge-base lamp and a terminal of a typical wedge-base lamp socket.
Figure 2:
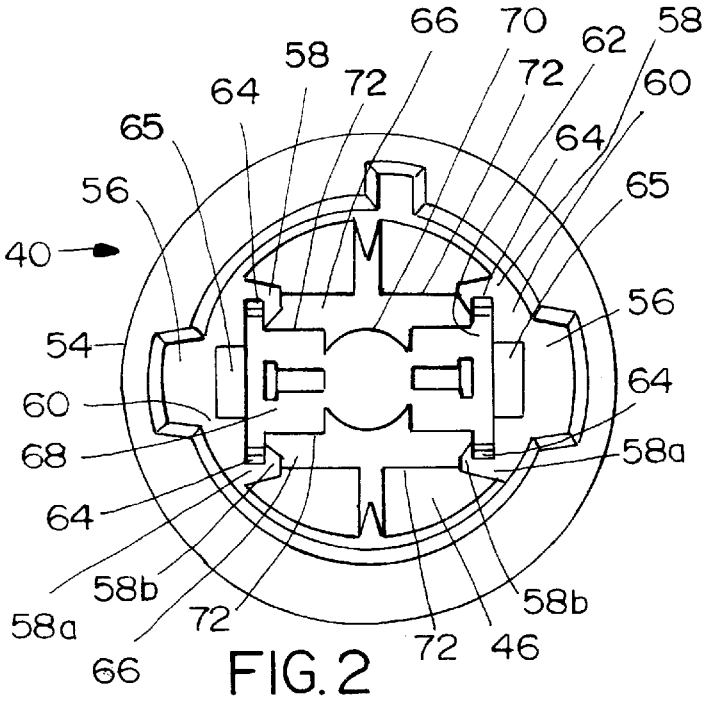
FIG. 2 (PRIOR ART)
FIG. 2 is a top plan view showing the construction of the typical wedge-base lamp socket.
Figure 3:
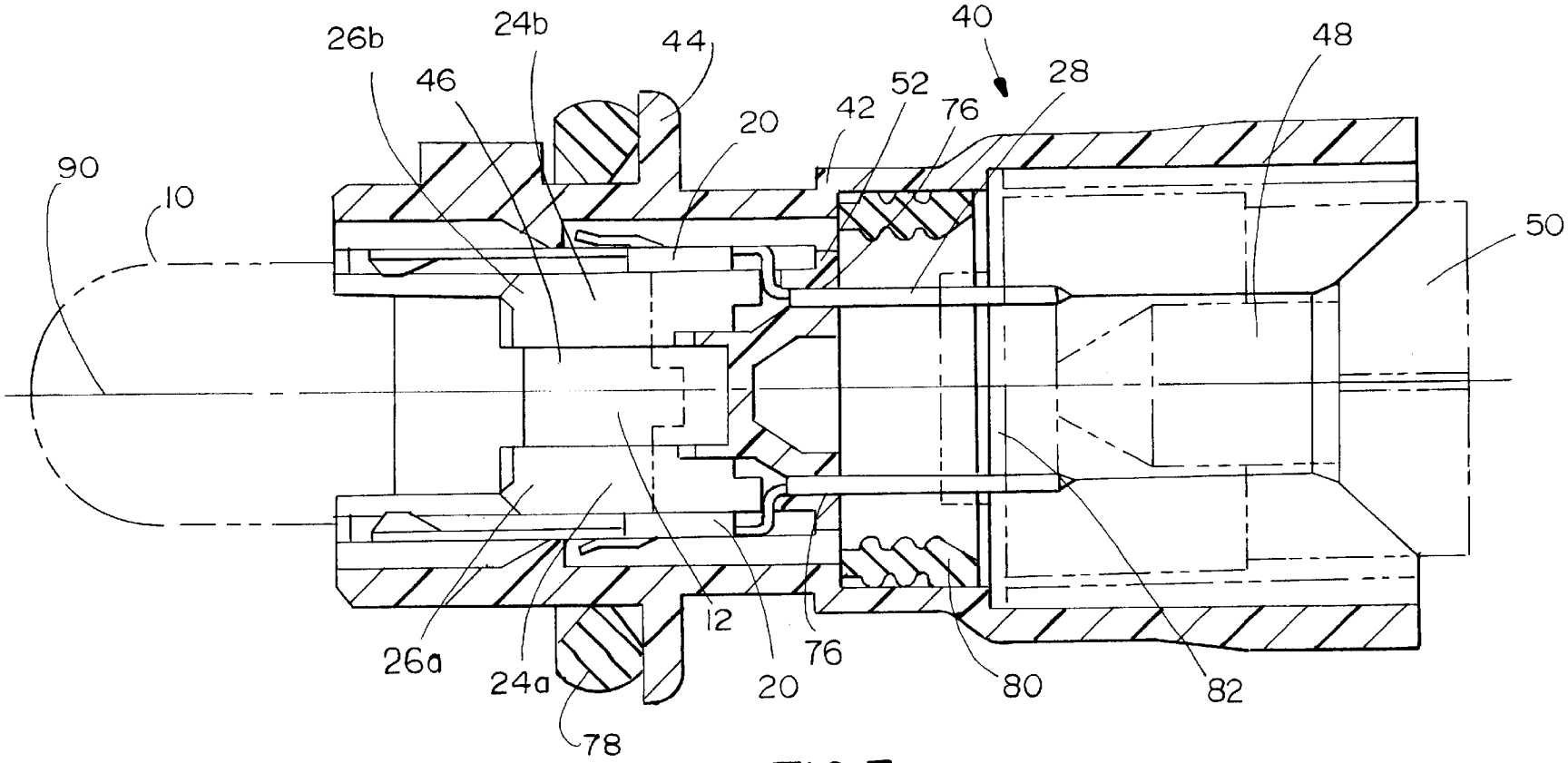
FIG. 3 (PRIOR ART)
FIG. 3 is a section view of the socket of FIG. 2.
Figure 4A:
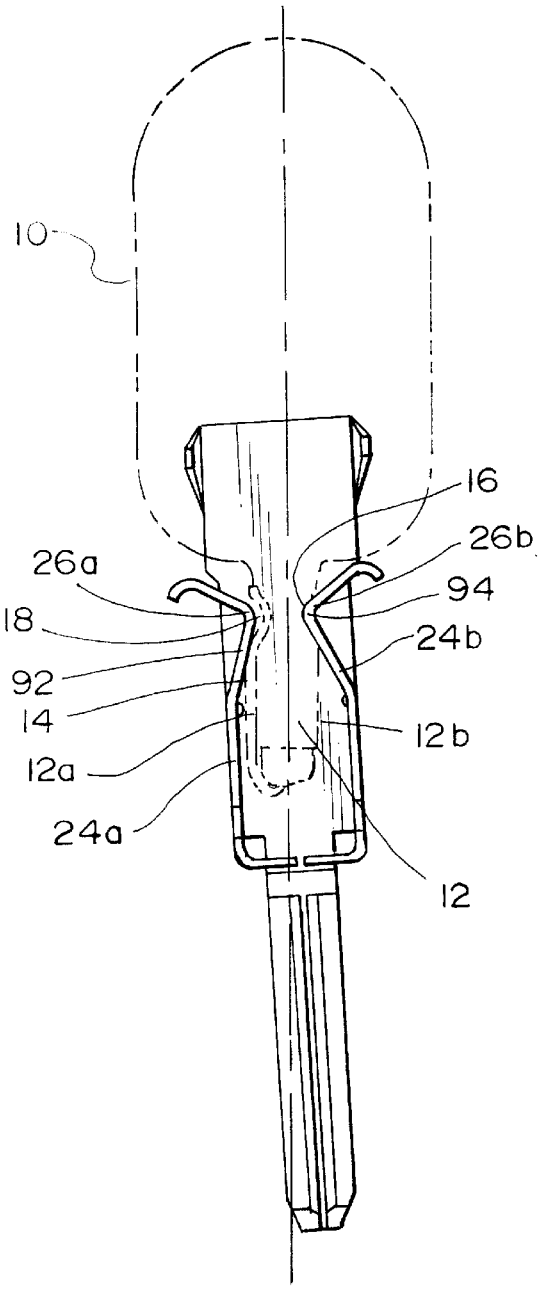
FIG. 4A (PRIOR ART)
FIG. 4*a* is an elevational view showing the interengagement between the terminal and the wedge-base lamp of FIG. 1.
Figure 4B:
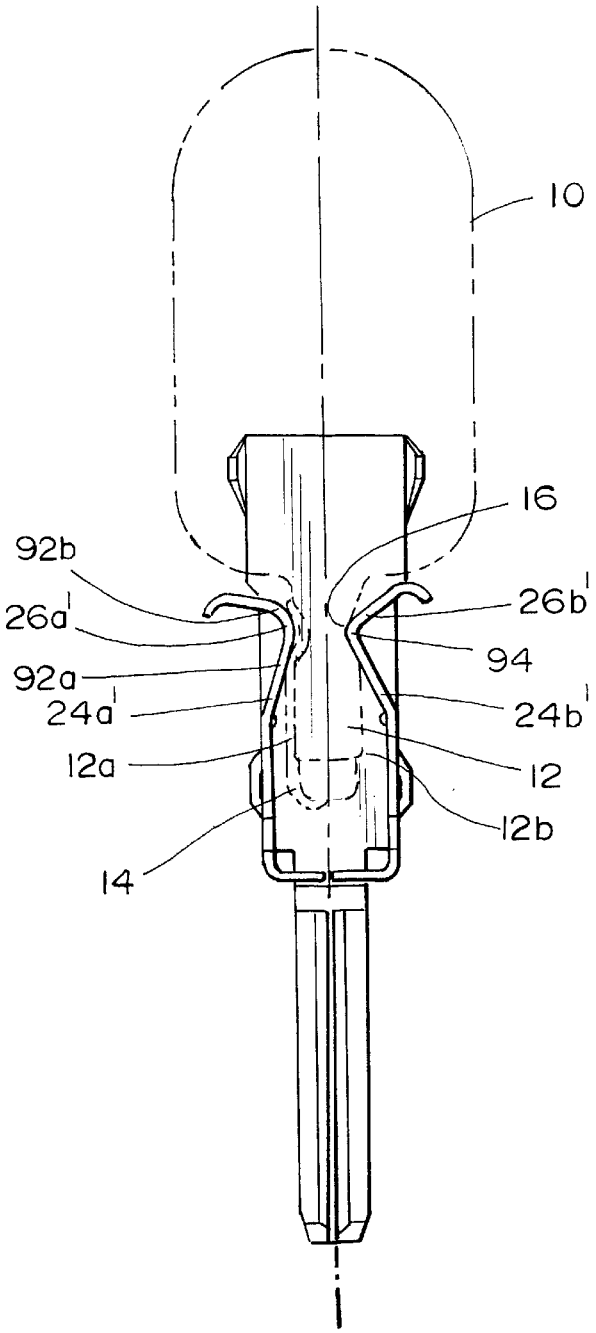
FIG. 4*b* is an elevational view showing the interengagement between a terminal used in a wedge-base lamp socket in accordance with a preferred embodiment of the present invention and the wedge-base lamp of FIG. 1.

When the wedge-base lamp 10 is inserted into the lamp holder 46' of the socket body 42', the first and second clamp arms 24*a*', 24*b*' of the terminals 20' on opposite sides of the lamp holder 46' flex outwardly to receive the wedge base 12 and then flex inwardly to clamp the wedge base 12 of the lamp 10. As shown in FIG. 4*b*, the first clamping bend 26*a*' of the first clamp arm 24*a*' engages the wire lead 14 folded back on the left half 12*l* of the first side 12*a* of the wedge base 12. The second clamping bend 26*b*' of the second clamp arm 24*b*' snaps into the indented portion 16 at an indent engagement point 94. Consequently, the first clamping bends 26*a*' establish electrical contact between the terminals 20' and the lamp 10, and the second clamping bends 26*b*' clamp the lamp 10 inside the lamp holder 46'.

Since the clamping bends 26 have a knurled surface 27, a greater frictional force is generated between the knurled clamping surface 27 on the first clamping bend 26*a*' and the wire lead 14 to prevent the wire leads 14 from sliding along the clamping surfaces 27. Thus, the likelihood of failure of the electrical contact between the wire lead 14 of the lamp 10 and the first clamping bend 26*a*' of the terminal 20' is diminished, even when subjected to the joggling of an automobile. The knurled clamping surface 27 on the second clamping bend 26*b*' also engages the glass base 12 with less slipping to ensure reliable clamping. The operational reliability of the wedge-base lamp socket 40' of this invention is thus further improved.

The first clamping bend 26*a*', preferably provided with a greater radius of curvature than the second clamping bend 26*b*', contacts the wire lead 14 bent over the left half 12*l*' of the first side 12*a* of the base 12 of the lamp 10. Because the wire lead 14 is bent only over the first side 12*a* of the left half 12*l* of the base, the first side 12*a* at the left half 12*l*' of the lamp has a wider profile than the second side 12*b* at the adjacent, right half 12*r*' of the lamp 10. By providing the first clamping bend 26*a*' with a greater radius of curvature, the clamp arm 24*a*' contacts the wire lead 14 at first and second contact points 92*a*, 92*b*. For example, in FIG. 4*b* which illustrates a lamp having a lead with a curved segment 18 nested in the indented portion 16, the first lead contact point 92*a* is between a portion of the clamp arm 24*a*' generally below the clamping bend 26*a*' and a portion of the wire lead 14 generally below the curved segment 18. Similarly, the second lead contact point 92*b* is between a portion of the clamp arm 24*a*' generally above the clamping bend 26*a*' and a portion of the wire lead 14 generally above the curved segment 18. The moment generated against the terminal 20 about the indent engagement point 94 by the first lead contact point 92*a* and the moment generated against the terminal 20 by the second lead contact point 92*b* at least partially counteract each other, thereby diminishing the bias which would rotate the terminal out of alignment with an axis of insertion 90.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

We claim:

1. A wedge-base lamp socket comprising:

a socket body having a lamp holder for holding a wedge-base lamp, said lamp holder including an outside wall and having a pair of opposite receiving portions disposed inside the outside wall, each of said receiving portions including a pair of opposed receiving grooves, and opposed inside walls diametrically extending between said receiving portions and defining an elongated channel therebetween for receiving a wedge base of a lamp, said opposed inside walls including a pair of opposed recesses adjacent to each of said receiving portions, each of said recesses in said pair of opposed recesses further including a guide groove therein extending longitudinally through the lamp holder, said guide grooves being disposed inwardly of said receiving grooves; and a pair of terminals oppositely mounted in said lamp holder, each terminal having a bracket part having opposed edges received within opposed receiving grooves of a respective one of said receiving portions and a pair of clamp arms connected to said bracket part, extended upwardly along both sides of said bracket part and adapted for clamping the wedge base of the lamp, each clamp arm being received within a respective recess in said pair of opposed recesses and including a protrusion on an outer surface of the clamp arm for reception in said guide groove, said protrusion comprising two legs extending from said clamp arm and a bridge extending between said two legs, said bridge defining a plane which is generally perpendicular to said bracket part.

2. The wedge-base lamp socket of claim 1, wherein each of said recesses are in alignment with the opposing recess.

3. The wedge-base lamp socket of claim 1, wherein each of said recesses comprises longitudinal walls, and the guide groove is disposed in one of said longitudinal walls which is facing the opposing recess.

4. The wedge-base lamp socket of claim 1, wherein the protrusion comprises a band defined by two slits in said clamp arm and said band being trapezoidally formed.

5. The wedge-base lamp socket of claim 1, wherein entry edge of said guide grooves are chamfered.

6. The wedge-base lamp socket of claim 1, wherein said clamp arms each include a free portion which is bent inwardly and bent outwardly about a clamping bend having an inner surface for engaging the wedge base of the lamp.

7. The wedge-base lamp socket of claim 6, wherein said inner surface of said clamping bend is knurled.

8. The wedge-base lamp socket of claim 1, wherein said opposed edges of said terminal include a pair of top flanges formed on both sides of said bracket part.

9. The wedge-base lamp socket of claim 8, wherein said flanges extend in a direction generally perpendicular to the direction in which the protrusion protrudes.

10. The wedge-base lamp socket of claim 8, wherein each receiving groove in said receiving portion receives a respective one of said pair of top flanges.

11. The wedge-base lamp socket of claim 10, wherein each receiving portion comprises a back side flanked by a pair of L-shaped walls, with a first portion extending from the back side and a second portion opposing said back side, to together define said pair of receiving grooves.

12. The wedge-base lamp socket of claim 6, wherein a first clamping bend on a first clamp arm in said pair of clamp arms has a greater radius of curvature than a second clamping bend on a second clamp arm in said pair of clamp arms.

13. The wedge-base lamp socket of claim 12, wherein said first clamp arm is on the left side of the terminal and said second clamp arm is on the right side of the terminal.

14. The wedge-base lamp socket of claim 12, wherein said first clamp arm contacts a lead of the wedge-base of a lamp at two discrete points.

15. A wedge-base lamp socket comprising:

a socket body having a lamp holder for holding a wedge-base lamp, said lamp holder including an outside wall and having a pair of opposite receiving portions disposed inside the outside wall, each of said receiving portions including a pair of opposed receiving grooves, and opposed inside walls diametrically extending between said receiving portions and defining an elongated channel therebetween for receiving a wedge base of a lamp, said opposed inside walls including a pair of opposed recesses adjacent to each of said receiving portions, each of said recesses in said pair of opposed recesses further including a guide groove therein longitudinally extending through a top of the lamp holder, said guide grooves being disposed inwardly of said opposed receiving grooves; and a first and a second terminal oppositely mounted in said lamp holder, each terminal having a generally planar bracket part having opposed edges received within opposed receiving grooves of a respective one of said receiving portions and a pair of clamp arms connected to said bracket part, said clamp arms extending upwardly along respective sides of said bracket part and bent inwardly and outwardly about a clamping bend with a knurled inner surface for clamping the wedge base of the lamp, said first clamp arm having a clamping bend with a greater radius of curvature than the clamping bend of the second clamp arm, and each clamp arm being received within a respective recess in said pair of opposed recesses and including a protrusion on an outer surface of the clamp arm for corresponding reception in said guide groove, said protrusion disposed inwardly of said outer edges of said bracket part and comprising two legs extending from said clamp arm and a bridge extending between said two legs, said bridge defining a plane that is perpendicular to said bracket part.

* * * * *